US006047992A

United States Patent [19]

Hampton

[11] Patent Number: 6,047,992

[45] Date of Patent: Apr. 11, 2000

[54] SHAMPOO AND HAIR CONDITIONER CONTAINERS INDICATING SYSTEM

[76] Inventor: Patricia Hampton, 1521 Waterbury Way, La Habra, Calif. 90631

[21] Appl. No.: 09/150,583

[22] Filed: Sep. 10, 1998

[51] Int. Cl.[7] ..... B42D 15/00; B65D 51/24

[52] U.S. Cl. ..... 283/81; 434/113; 206/534; 206/432; 156/86

[58] Field of Search ..... 434/113, 114; 283/81, 114, 56, 79, 80, 101; 40/310, 630, 312, 299; 206/534, 432

[56] References Cited

U.S. PATENT DOCUMENTS

| | | | |
|---|---|---|---|
| 110,760 | 1/1871 | Harrison . | |
| 1,868,188 | 7/1932 | Barker . | |
| 2,051,665 | 8/1936 | West . | |
| 4,444,839 | 4/1984 | Dudzik et al. | 428/336 |
| 4,737,108 | 4/1988 | Chepaitis | 434/113 |
| 4,802,295 | 2/1989 | Darrr | 40/310 |
| 4,847,183 | 7/1989 | Kruger | 430/322 |
| 4,883,697 | 11/1989 | Dornbusch et al. | 428/35.7 |
| 4,895,257 | 1/1990 | Winslow | 206/534 |
| 4,998,985 | 3/1991 | Sankey | 206/387 |
| 5,011,032 | 4/1991 | Rollman | 215/230 |
| 5,148,656 | 9/1992 | Meaghan | 54/36 |
| 5,280,834 | 1/1994 | Berekley | 206/5.1 |
| 5,316,159 | 5/1994 | Douglas et al. | 215/210 |
| 5,377,853 | 1/1995 | Papciak | 215/230 |
| 5,395,137 | 3/1995 | Kim | 283/114 |
| 5,497,879 | 3/1996 | Kao | 206/389 |
| 5,650,217 | 7/1997 | Skrivanek et al. | 428/195 |
| 5,685,721 | 11/1997 | Decker | 434/112 |
| 5,730,292 | 3/1998 | Jones | 206/534 |
| 5,753,350 | 5/1998 | Bright | 428/195 |
| 5,764,131 | 6/1998 | Twining et al. | 340/311.1 |
| 5,858,143 | 1/1999 | Bright et al. | 156/86 |
| 5,894,947 | 4/1999 | Morano | 215/11.3 |
| 5,922,422 | 7/1999 | Otruba | 428/34.1 |

FOREIGN PATENT DOCUMENTS

| | | | |
|---|---|---|---|
| 2419823 | 11/1979 | France | 283/79 |

*Primary Examiner*—Willmon Fridie, Jr.
*Assistant Examiner*—Alisa L Thurston

[57] ABSTRACT

A shampoo and hair conditioner containers indicating system for systems for distinguishing shampoo and hair conditioner containers. The system includes first and second raised letters. The first raised letter is configured to resemble the letter S and the second raised letter is configured to resemble the letter C. The first raised letter is adapted for attachment to a shampoo container. The second raised letter is adapted for attachment to a hair conditioner container. The first and second raised letters have tactilely distinguishable exteriors from one another.

16 Claims, 3 Drawing Sheets

SHAMPOO AND HAIR CONDITIONER CONTAINERS INDICATING SYSTEM

BACKGROUND OF THE INVENTION

1. Field of the Invention

The present invention relates to systems for distinguishing shampoo and hair conditioner containers and more particularly pertains to a new shampoo and hair conditioner containers indicating system for systems for distinguishing shampoo and hair conditioner containers.

2. Description of the Prior Art

The use of systems for distinguishing shampoo and hair conditioner containers is known in the prior art. More specifically, systems for distinguishing shampoo and hair conditioner containers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,286,204; U.S. Pat. No. 4,650,421; U.S. Pat. No. 4,226,420; U.S. Pat. No. 5,395,137; U.S. Pat. No. Des. 286,911; and U.S. Pat. No. 3,443,710.

While these devices fulfill their respective, particular objectives and requirements, the aforementioned patents do not disclose a new shampoo and hair conditioner containers indicating system. The inventive device includes first and second raised letters. The first raised letter is configured to resemble the letter S and the second raised letter is configured to resemble the letter C. The first raised letter is adapted for attachment to a shampoo container. The second raised letter is adapted for attachment to a hair conditioner container. The first and second raised letters have tactilely distinguishable exteriors from one another.

In these respects, the shampoo and hair conditioner containers indicating system according to the present invention substantially departs from the conventional concepts and designs of the prior art, and in so doing provides an apparatus primarily developed for the purpose of systems for distinguishing shampoo and hair conditioner containers.

SUMMARY OF THE INVENTION

In view of the foregoing disadvantages inherent in the known types of systems for distinguishing shampoo and hair conditioner containers now present in the prior art, the present invention provides a new shampoo and hair conditioner containers indicating system construction wherein the same can be utilized for systems for distinguishing shampoo and hair conditioner containers.

The general purpose of the present invention, which will be described subsequently in greater detail, is to provide a new shampoo and hair conditioner containers indicating system apparatus and method which has many of the advantages of the systems for distinguishing shampoo and hair conditioner containers mentioned heretofore and many novel features that result in a new shampoo and hair conditioner containers indicating system which is not anticipated, rendered obvious, suggested, or even implied by any of the prior art systems for distinguishing shampoo and hair conditioner containers, either alone or in any combination thereof.

To attain this, the present invention generally comprises first and second raised letters. The first raised letter is configured to resemble the letter S and the second raised letter is configured to resemble the letter C. The first raised letter is adapted for attachment to a shampoo container. The second raised letter is adapted for attachment to a hair conditioner container. The first and second raised letters have tactilely distinguishable exteriors from one another.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new shampoo and hair conditioner containers indicating system apparatus and method which has many of the advantages of the systems for distinguishing shampoo and hair conditioner containers mentioned heretofore and many novel features that result in a new shampoo and hair conditioner containers indicating system which is not anticipated, rendered obvious, suggested, or even implied by any of the prior art systems for distinguishing shampoo and hair conditioner containers, either alone or in any combination thereof.

It is another object of the present invention to provide a new shampoo and hair conditioner containers indicating system which may be easily and efficiently manufactured and marketed.

It is a further object of the present invention to provide a new shampoo and hair conditioner containers indicating system which is of a durable and reliable construction.

An even further object of the present invention is to provide a new shampoo and hair conditioner containers indicating system which is susceptible of a low cost of manufacture with regard to both materials and labor, and which accordingly is then susceptible of low prices of sale to the consuming public, thereby making such shampoo and hair conditioner containers indicating system economically available to the buying public.

Still yet another object of the present invention is to provide a new shampoo and hair conditioner containers indicating system which provides in the apparatuses and methods of the prior art some of the advantages thereof, while simultaneously overcoming some of the disadvantages normally associated therewith.

Still another object of the present invention is to provide a new shampoo and hair conditioner containers indicating system for systems for distinguishing shampoo and hair conditioner containers.

Yet another object of the present invention is to provide a new shampoo and hair conditioner containers indicating system which includes first and second raised letters. The first raised letter is configured to resemble the letter S and the second raised letter is configured to resemble the letter C. The first raised letter is adapted for attachment to a shampoo container. The second raised letter is adapted for attachment to a hair conditioner container. The first and second raised letters have tactilely distinguishable exteriors from one another.

Still yet another object of the present invention is to provide a new shampoo and hair conditioner containers indicating system that lets a user tactilely distinguish between a container of shampoo and a container of hair conditioner when washing and showering. This is especially helpful for users of limited sight such as blind users and users who wear eyeglasses.

Even still another object of the present invention is to provide a new shampoo and hair conditioner containers indicating system that may be integrally formed on the container or provided as an attachment for attaching to a pre-existing container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
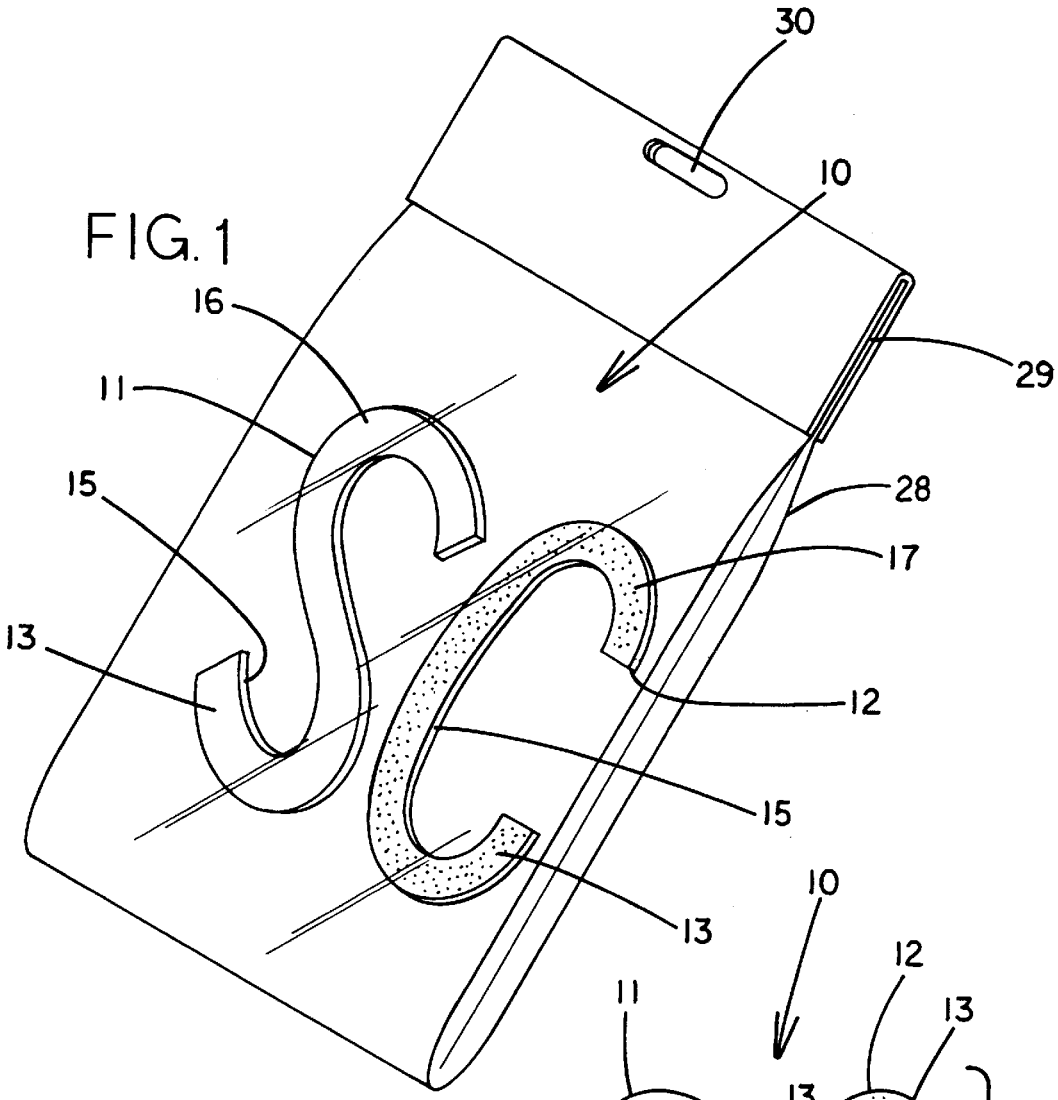
FIG. 1 is a schematic perspective view of an embodiment of a new shampoo and hair conditioner containers indicating system according to the present invention.

With reference now to the drawings, and in particular to FIGS. 1 through 6 thereof, a new shampoo and hair conditioner containers indicating system embodying the principles and concepts of the present invention and generally designated by the reference numeral 10 will be described.

As best illustrated in FIGS. 1 through 6, the shampoo and hair conditioner containers indicating system 10 generally comprises first and second raised letters 11,12. The first raised letter 11 is configured to resemble the letter S and the second raised letter 12 is configured to resemble the letter C. The first raised letter 11 is adapted for attachment to a shampoo container 20. The second raised letter 12 is adapted for attachment to a hair conditioner container 23. The first and second raised letters 11,12 have tactilely distinguishable exteriors from one another.

In use, the system 10 is designed for distinguishing between a shampoo container 20 and a hair conditioner container 23. In closer detail, the system 10 comprises first and second raised letters 11,12. The first raised letter 11 is configured to resemble the letter S. The second raised letter 12 is configured to resemble the letter C. In use, the first raised letter 11 is adapted for attachment to a shampoo container 20 and the second raised letter 12 is adapted for attachment to a hair conditioner container 23. The first and second raised letters 11,12 have tactilely distinguishable exteriors from one another. The first and second raised letters 11,12 each have spaced apart front and back faces 13,14 and a perimeter side 15 therebetween around the outer perimeters of the front and back faces 13,14. The first and second raised letters 11,12 each preferably has a generally rectangular transverse cross section with the front and back faces 13,14 of each raised letter preferably lying in generally parallel planes to one another. Each of the raised letters 11,12 has a thickness defined between the front and back surfaces of the respective raised letter. The thickness of each of the raised letters 11,12 is preferably greater than about ⅛ inch. Even more preferably, the thickness' of the raised letters are generally equal to one another. Ideally, the thickness of each of the raised letters is about ¼ inch. Preferably, the length of each of the faces of each raised letter is at least about twice the width of the respective face. In an ideal illustrative embodiment, each of the faces 13,14 of the raised letters 11,12 has a width and a length several times larger than the thickness of the respective raised letter.

Figure 2:
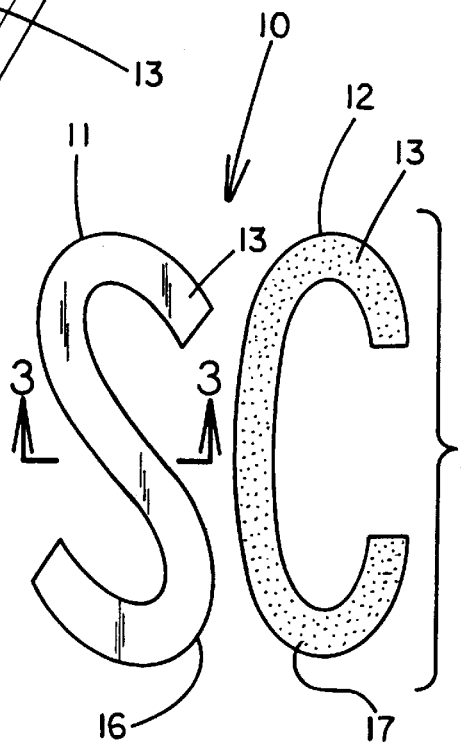
FIG. 2 is a schematic front side view of the embodiment of the present invention illustrated in FIG. 1.

As shown in FIG. 2, the exterior of the first raised letter 11 has a generally smooth to touch surface 16. The exterior of the second raised letter 12 has a roughened or coarse surface 17 which is rough to touch with respect to the smooth surface 16 of the exterior of the first raised surface. The smooth surface 16 of the first raised letter 11 is provided on the front face of the first raised letter 11 and the roughened surface 17 of the second raised letter 12 is provided on the front face of the second raised letter 12.

Figure 3:
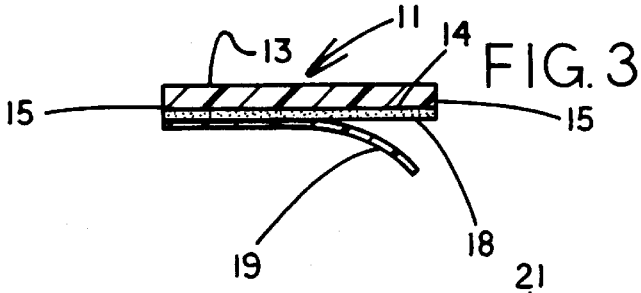
FIG. 3 is a schematic cross sectional view of the present invention taken from line 3—3 of FIG. 2.

In a preferred embodiment as illustrated in FIG. 3, the back faces 14 of the raised letters have an adhesive 18 provided thereon adapted for adhesively attaching the back face of the respective raised letter 11,12 to the exterior of the associated container 20,23/ In a first preferred embodiment, the raised letters are adhesively attachable to a side 22,25 of the respective container. In a second preferred embodiment, the raised letters are adhesively attachable to a cap 21,24 of the respective container.

In this preferred adhesive embodiment, each of the raised letters ideally has a protective cover sheet 19 substantially covering the adhesive 18 on the respective bottom face. The protective cover sheet 19 preferably comprises a flexible material adapted for easy removal from the adhesive 18 with little residue of the adhesive 18 remaining on the protective cover sheet 19 when removed from the adhesive 18.

Ideally, in this preferred embodiment, the first and second raised letters 11,12 are enclosed in a generally transparent package 28. With reference to FIG. 1, the package 28 is preferably generally flexible and has an opening substantially closed by a cardstock flap 29 with a hole 30 therethrough adapted for extending a display hook through for hanging the package 28 on the display hook.

Figure 4:
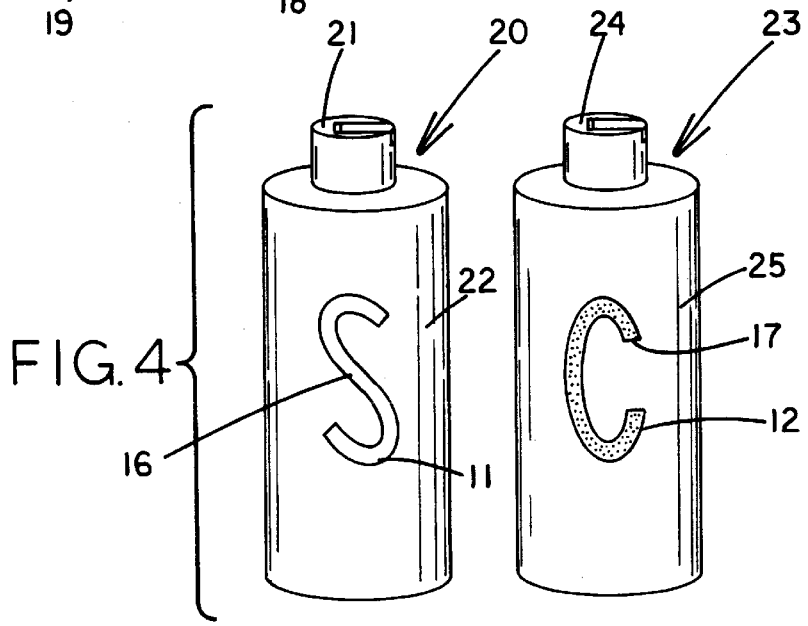
FIG. 4 is a schematic perspective view of the present invention on the sides of a shampoo container and hair conditioner container.
Figure 5:
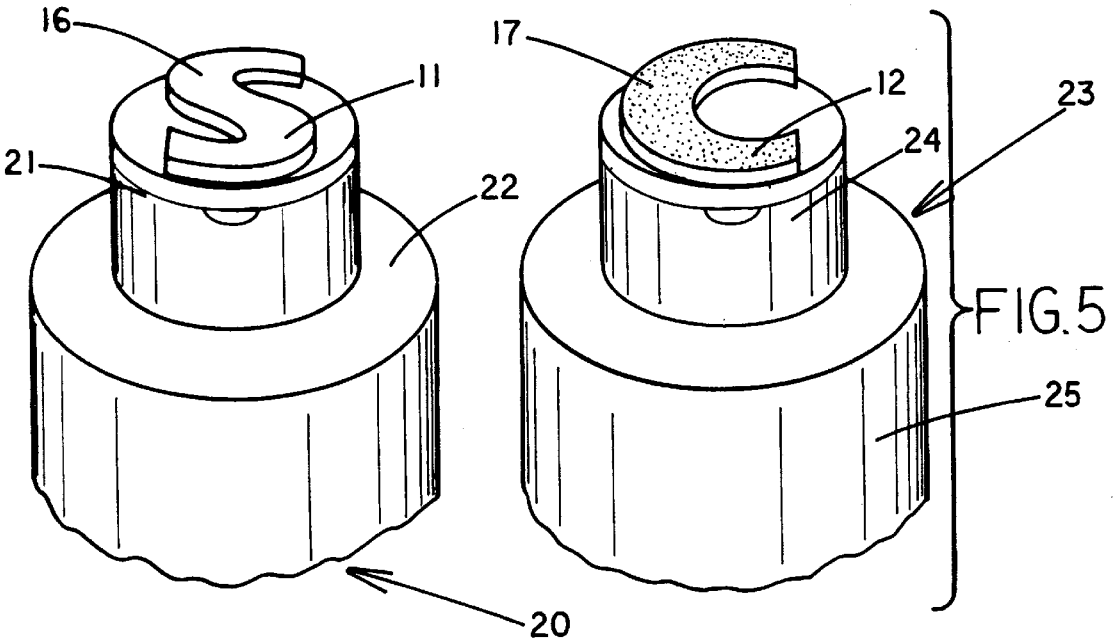
FIG. 5 is a schematic perspective view of an embodiment of the present invention with the raised lettering on the caps of the containers.
Figure 6:
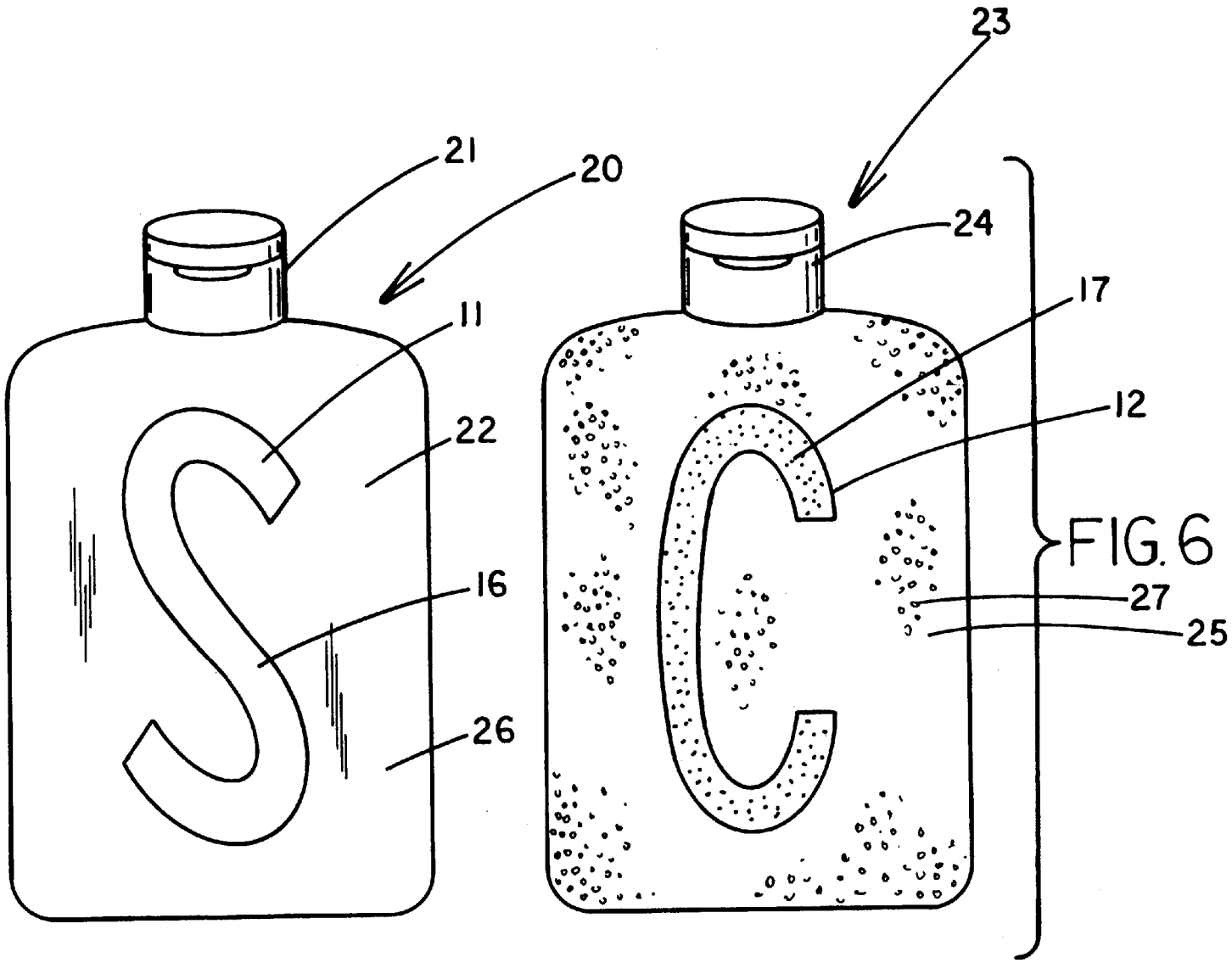
FIG. 6 is a schematic side view of an embodiment of the present invention with the containers having tactilely distinguishable surfaces.

As illustrated in FIG. 4, the shampoo container 20 has a side 22 and a cap 21. The hair conditioner container 23 also has a side 25 and a cap 24. In another preferred embodiment, the first raised letter 11 is integrally formed with the shampoo container 20 such that the first raised letter 11 outwardly extends from the shampoo container 20 and the second raised letter 12 is integrally formed with the hair conditioner container 23 such that the second raised letter 12 outwardly extends from the hair conditioner container 23. In a first ideal embodiment as illustrated in FIG. 5, the first and second raised letters 11,12 are located on the cap 21,24 of the respective container 20,23. In a second ideal embodiment, the first and second raised letters 11,12 are located on the side 22,25 of the respective container. Preferably, the sides 22,25 of the shampoo and hair conditioner containers 20,23 are tactilely distinguishable from one another. Ideally, with reference to FIG. 6, the side 22 of the shampoo container 20 has a smooth to touch surface 26 and the side 25 of the hair conditioner container 23 has a roughened surface 27 that is rough to touch with respect to the smooth surface 26 of the side 22 of the shampoo container 20. This permit even easier distinguishing of the shampoo container 20 and the hair conditioner container 23.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A system for distinguishing between a shampoo container and a hair conditioner container, said system comprising:

first and second raised letters, said first raised letter being configured to resemble the letter S, said second raised letter being configured to resemble the letter C;

said first raised letter being adapted for attachment to a shampoo container, said second raised letter being adapted for attachment to a hair conditioner container;

said first letter having an outwardly facing surface when said first letter is coupled to the shampoo container, an entirety of said outwardly facing surface of said first letter being smooth to the touch of a user; and said second letter having an outwardly facing surface when said second letter is coupled to the hair conditioner container, an entirety of said outwardly facing surface of said second letter being rough to the touch of the user whereby said outwardly facing surface of said first letter is tactilely distinguishable from said outwardly facing surface of said second letter.

2. The system of claim 1, wherein said first and second raised letters each have spaced apart front and back faces, each of said first and second raised letters further having a perimeter side extending between the front and back faces.

3. The system of claim 2, wherein said first and second raised letters each have a generally rectangular transverse cross section, said front and back faces of each raised letter lying in generally parallel planes to one another.

4. The system of claim 2, wherein each of said raised letters has a thickness defined between said front and back surfaces of the respective raised letter, wherein said thickness of each of said raised letters is greater than about ⅛ inch.

5. The system of claim 4, wherein said thickness of each of said raised letters is about ¼ inch.

6. The system of claim 4, wherein said thickness' of said raised letters are generally equal to one another.

7. The system of claim 2, wherein said back faces of said raised letters have an adhesive provided thereon adapted for adhesively attaching said back face of the respective raised letter to the exterior of the associated container.

8. The system of claim 7, wherein said raised letters are adhesively attachable to a side of the respective container.

9. The system of claim 7, wherein said raised letters are adhesively attachable to a cap of the respective container.

10. The system of claim 7, wherein each of said raised letters has a protective cover sheet substantially covering said adhesive on the respective bottom face, wherein said protective cover sheet comprises a flexible material adapted for peelable removal from the adhesive with little residue of said adhesive remaining on said protective cover sheet when removed from the adhesive.

11. A system for distinguishing between a shampoo container and a hair conditioner container, said system comprising, in combination:

a shampoo container having a side and a cap, and a hair conditioner container having a side and a cap;

first and second raised letters, said first raised letter being configured to resemble the letter S, said second raised letter being configured to resemble the letter C;

said first raised letter being integrally attached to said shampoo container such that said first raised letter extends outwardly from said shampoo container, said second raised letter being integrally attached to said hair conditioner container such that said second raised letter extends outwardly from said hair conditioner container;

said first letter having an outwardly facing surface, an entirety of said outwardly facing surface of said first letter being smooth to the touch of a user;

said second letter having an outwardly facing surface, an entirety of said outwardly facing surface of said second letter being rough to the touch of the user whereby said outwardly facing surface of said first letter is tactilely distinguishable from said outwardly facing surface of said second letter.

12. The system of claim 11, wherein said first and second raised letters are located on said cap of the respective container.

13. The system of claim 11, wherein said first and second raised letters are located on said side of the respective container.

14. The system of claim 11, wherein said sides of said shampoo and hair conditioner containers are tactilely distinguishable from one another.

15. The system of claim 14, wherein said side of said shampoo container has a smooth surface, and said side of said hair conditioner container has a roughened surface.

16. A system for distinguishing between a shampoo container and a hair conditioner container, said system comprising:

first and second raised letters, said first raised letter being configured to resemble the letter S, said second raised letter being configured to resemble the letter C;

said first raised letter being adapted for attachment to a shampoo container, said second raised letter being adapted for attachment to a hair conditioner container;

said first letter having an outwardly facing surface when said first letter is coupled to the shampoo container, an entirety of said outwardly facing surface of said first letter being smooth to the touch of a user; and said second letter having an outwardly facing surface when said second letter is coupled to the hair conditioner container, an entirety of said outwardly facing surface of said second letter being rough to the touch of the user whereby said outwardly facing surface of said first letter is tactilely distinguishable from said outwardly facing surface of said second letter;

said first and second raised letters each having spaced apart front and back faces and a perimeter side therebetween around the outer perimeters of the front and back faces;

said first and second raised letters each having a generally rectangular transverse cross section, said front and back faces of each raised letter lying in generally parallel planes to one another;

each of said raised letters having a thickness defined between said front and back surfaces of the respective raised letter, wherein said thickness' of said raised letters are generally equal to one another, wherein said thickness of each of said raised letters is about ¼ inch;

wherein each of said faces of said raised letters having a width and a length several times larger than said thickness of the respective raised letters;

wherein the length of each of the faces of each raised letter is at least about twice the width of the respective face;

said exterior of said first raised letter having a generally smooth surface, said exterior of said second raised letter having a roughened surface whereby said raised letters are adapted for facilitating distinguishing between said first raised letter and said second raised letter by touch;

wherein said smooth surface of said first raised letter is provided on said front face of said first raised letter, wherein said roughened surface of said second raised letter is provided on said front face of said second raised letter;

said back faces of said raised letters having an adhesive provided thereon adapted for adhesively attaching said back face of the respective raised letter to the exterior of the associated container;

each of said raised letters having a protective cover sheet substantially covering said adhesive on the respective bottom face, wherein said protective cover sheet comprises a flexible material adapted for peelable removal from the adhesive with little residue of said adhesive remaining on said protective cover sheet when removed from the adhesive; and wherein said first and second raised letters are enclosed in a generally transparent package, wherein said package is generally flexible and has an opening substantially closed by a cardstock flap having a hole therethrough adapted for extending a display hook through for hanging the package on the display hook.

* * * * *